US006571434B2

(12) United States Patent
Ortiz

(10) Patent No.: US 6,571,434 B2
(45) Date of Patent: Jun. 3, 2003

(54) CONNECTOR DEVICE FOR RELEASABLY SECURING A STRAP MEMBER AND A FASTENING MECHANISM TOGETHER

(76) Inventor: Kim A. Ortiz, 1500 W. Thornton Pkwy. #292, Denver, CO (US) 80221

( * ) Notice: Subject to any disclaimer, the term of this patent is extended or adjusted under 35 U.S.C. 154(b) by 0 days.

(21) Appl. No.: 09/954,569

(22) Filed: Sep. 12, 2001

(65) Prior Publication Data

US 2002/0029443 A1 Mar. 14, 2002

Related U.S. Application Data

(60) Provisional application No. 60/232,386, filed on Sep. 14, 2000.

(51) Int. Cl.[7] ..... A44B 21/00
(52) U.S. Cl. ..... 24/615; 24/265 BC
(58) Field of Search ..... 24/265 EC, 265 BC, 24/115 M, 136 R, 460, 535, 536, 537, 542

(56) References Cited

U.S. PATENT DOCUMENTS 3,002,240 A * 10/1961 Laguerre ..... 24/30.5 L
3,309,742 A * 3/1967 Chin ..... 24/30.5 L
3,520,033 A 7/1970 Usuda
3,836,049 A 9/1974 Smith
4,393,556 A 7/1983 Yuda et al.
4,455,717 A * 6/1984 Gray ..... 24/115 R
4,569,106 A 2/1986 Lovato
4,577,377 A 3/1986 Kasai
4,779,315 A 10/1988 Kohus
4,800,629 A 1/1989 Ikeda
4,864,700 A 9/1989 Kasai
4,894,890 A 1/1990 Kasai
4,947,527 A 8/1990 Hennig
5,203,058 A 4/1993 Krauss
5,388,313 A * 2/1995 Cameron ..... 24/537
5,392,616 A 2/1995 Ballenegger
5,735,024 A 4/1998 Ortiz
6,389,653 B1 * 5/2002 Matoba ..... 24/265 BC

* cited by examiner

*Primary Examiner*—Robert J. Sandy
(74) *Attorney, Agent, or Firm*—Emery L. Tracy

(57) ABSTRACT

A connector mechanism for releasably securing a length of material and a fastening mechanism together is provided. The connector device comprises a compressible first device connected to the fastening mechanism with at least a portion of the material receivable within the first device. A second device is positionable over at least a portion of the first device. A securing mechanism associated with the first device and the second device releasably secures the first device to the second device wherein the second device compresses the first device about the portion of the material receivable therein thereby securing the first device to the material.

14 Claims, 7 Drawing Sheets

FIG. 5
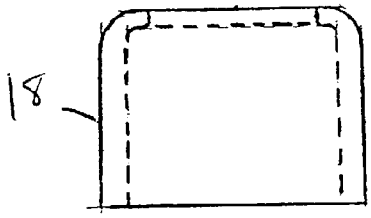
FIG. 6
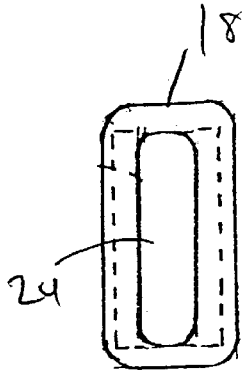
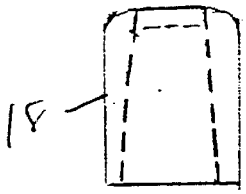
FIG. 7
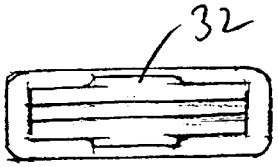
FIG. 9
FIG. 10
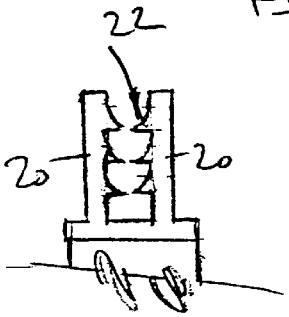
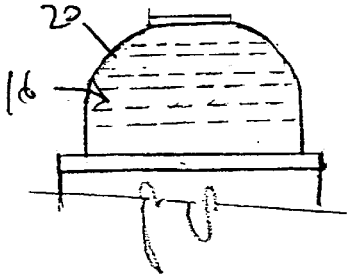
FIG. 8

CONNECTOR DEVICE FOR RELEASABLY SECURING A STRAP MEMBER AND A FASTENING MECHANISM TOGETHER

The present application is a continuation of provisional patent application Ser. No. 60/232,386, filed on Sep. 14, 2000, now abandoned entitled "Connector Device for Releasably Securing a Strap Member and a Fastening Mechanism Together".

BACKGROUND OF THE INVENTION

1. Field of the Invention

This invention relates generally to connector device for securing a strap member and a fastening mechanism together and, more particularly, it relates to a connector device which releasably secures a fastening mechanism to a strap member without modification and/or alteration of the fastening mechanism or the strap member.

2. Description of the Prior Art

Fastening mechanisms are well known for releasably closing various articles including, but not limited to, backpacks, brief bags, camping equipment, etc. Typically, the fastening mechanism is attached to the various articles via a nylon strap or the like which itself is attached to the various article. It is known that to connect the fastening mechanism to the strap, the strap is inserted through a slot in the fastening mechanism and overlapped upon itself. Sewing connections are then provided between overlapped strap ends to secure the fastening mechanism to the strap.

Unfortunately, over time, the connection between the strap and the fastening mechanism begins to wear or the sewing connection is compromised such that eventually, the strap must be replaced. Furthermore, the fastening mechanism is sometimes damaged such that the fastening mechanism is released from the connection with the strap. In order to return the article to a satisfactory operating condition, the user must remove the strap from the article and either replace with a useful, non-damaged strap or secure a non-damaged fastening mechanism. Since removal of the strap from the article is a time consuming, sometimes costly endeavor, the user will oftentimes just continue to use the article with the damaged strap rather than correct and replace the problem. As will be understood, with a non-secure article, items being carried or transported within the article can be lost or damaged.

Accordingly, there exists a need for a connector device for releasably securing a strap member and a fastening mechanism together. Additionally, a need exists for a connector device for releasably securing a strap member and a fastening mechanism together which allows a user to replace a fastening mechanism without removing the strap. Furthermore, there exists a need for a connector device for releasably securing a strap member and a fastening mechanism together which can accommodate a wide variety of strap members having a wide variety of strap widths.

SUMMARY

The present invention is a connector mechanism for releasably securing a length of material and a fastening mechanism together. The connector device comprises a compressible first device connected to the fastening mechanism with at least a portion of the material receivable within the first device. A second device is positionable over at least a portion of the first device. A securing mechanism associated with the first device and the second device releasably secures the first device to the second device wherein the second device compresses the first device about the portion of the material receivable therein thereby securing the first device to the material.

The present invention additionally includes a device for connecting a strap to a fastening mechanism. The device comprises gripping means connected to the fastening mechanism for gripping the strap and compression means for compressing the gripping means about the strap.

The present invention further includes a method for connecting material to a fastening mechanism. The method comprises extending a first compression member from the fastening mechanism, extending a second compression member from the fastening mechanism, inserting at least a portion of the material between the first compression member and the second compression member, providing a compression member, positioning the compression member over the first compression member and the second compression member, and compressing the material between the first compression member and the second compression member.

BRIEF DESCRIPTION OF THE DRAWINGS

FIG. 5 is a front view illustrating a female locking sleeve of the connector device for releasably securing a strap and a fastening mechanism together, constructed in accordance with the present invention, with a male entity and a female locking sleeve;

FIG. 6 is a top view illustrating the female locking sleeve of the connector device for releasably securing a strap and a fastening mechanism together as illustrated in FIG. 5, constructed in accordance with the present invention;

FIG. 7 is a side view illustrating the female locking sleeve of the connector device for releasably securing a strap and a fastening mechanism together as illustrated in FIG. 5, constructed in accordance with the present invention;

FIG. 8 is front view illustrating a male entity of the connector device for releasably securing a strap and a fastening mechanism together, constructed in accordance with the present invention;

FIG. 9 is a top view illustrating the male entity of the connector device for releasably securing a strap and a fastening mechanism together as illustrated in FIG. 8, constructed in accordance with the present invention;

FIG. 10 is a side view illustrating the male entity of the connector device for releasably securing a strap and a fastening mechanism together as illustrated in FIG. 8, constructed in accordance with the present invention;

DETAILED DESCRIPTION OF THE PREFERRED EMBODIMENTS

Figure 1:
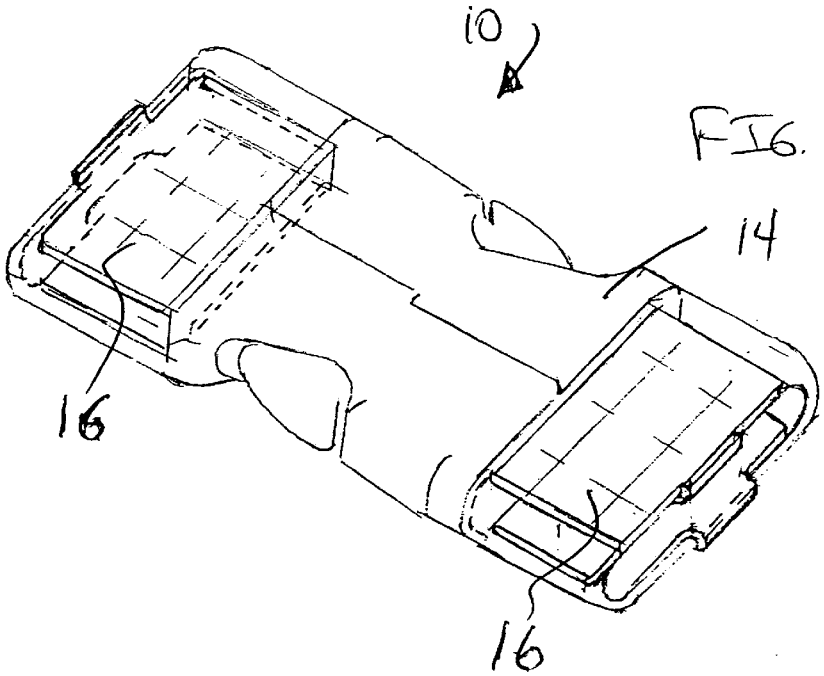
FIG. 1 is a perspective view illustrating a connector device for releasably securing a strap and a fastening mechanism together, constructed in accordance with the present invention, with a first fastening mechanism releasably secured to a second fastening mechanism.
Figure 2:
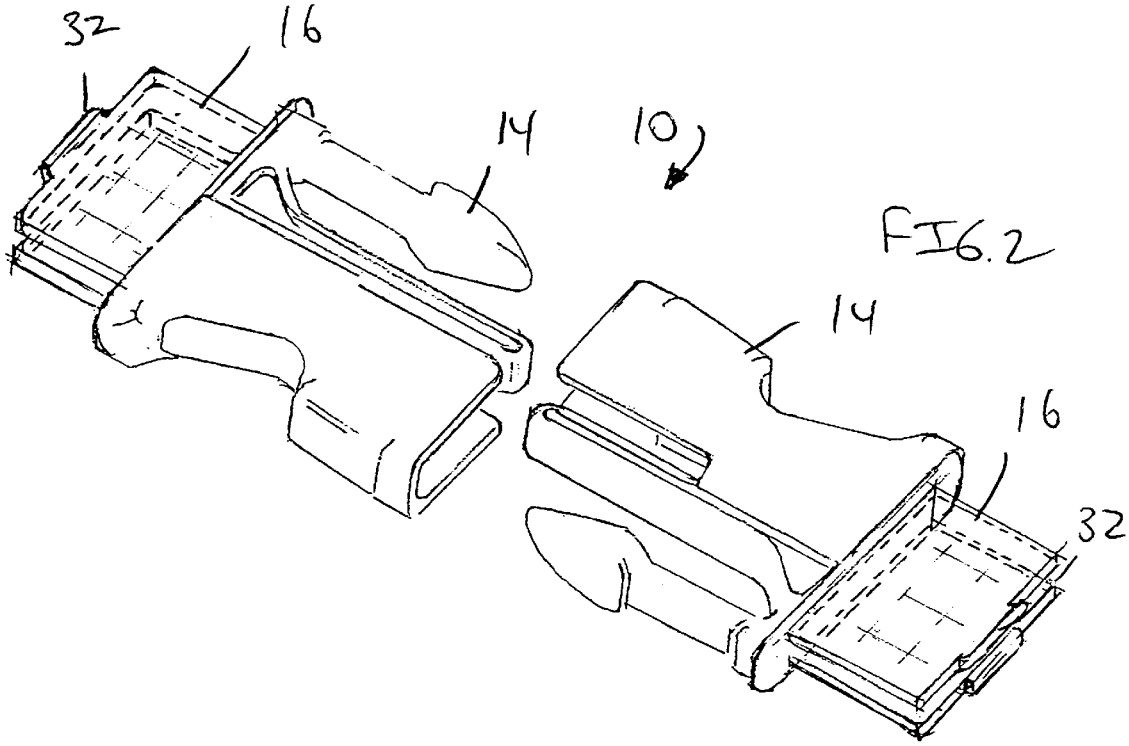
FIG. 2 is a perspective view illustrating the connector device for releasably securing a strap and a fastening mechanism together as illustrated in FIG. 1, constructed in accordance with the present invention, with the first fastening mechanism released from the second fastening mechanism.

As illustrated in FIGS. 1 and 2, the present invention is a connector device, indicated generally at 10, for releasably securing a strap member 12 (see FIG. 3) and a fastening mechanism 14 together. While the present invention will be described herein as releasably securing a strap member 12, a person skilled in the art will understand the connector device 10 of the present invention can be used with other types of material including, but not limited to, webbing, cords, ropes, etc. Furthermore, the fastening mechanism 14 can be any type of fastening mechanism 14 including the fastening mechanism 14 as described in U.S. Pat. No. 5,735,024, owned by the inventor of the present application, and herein hereby incorporated by reference.

Figure 3:
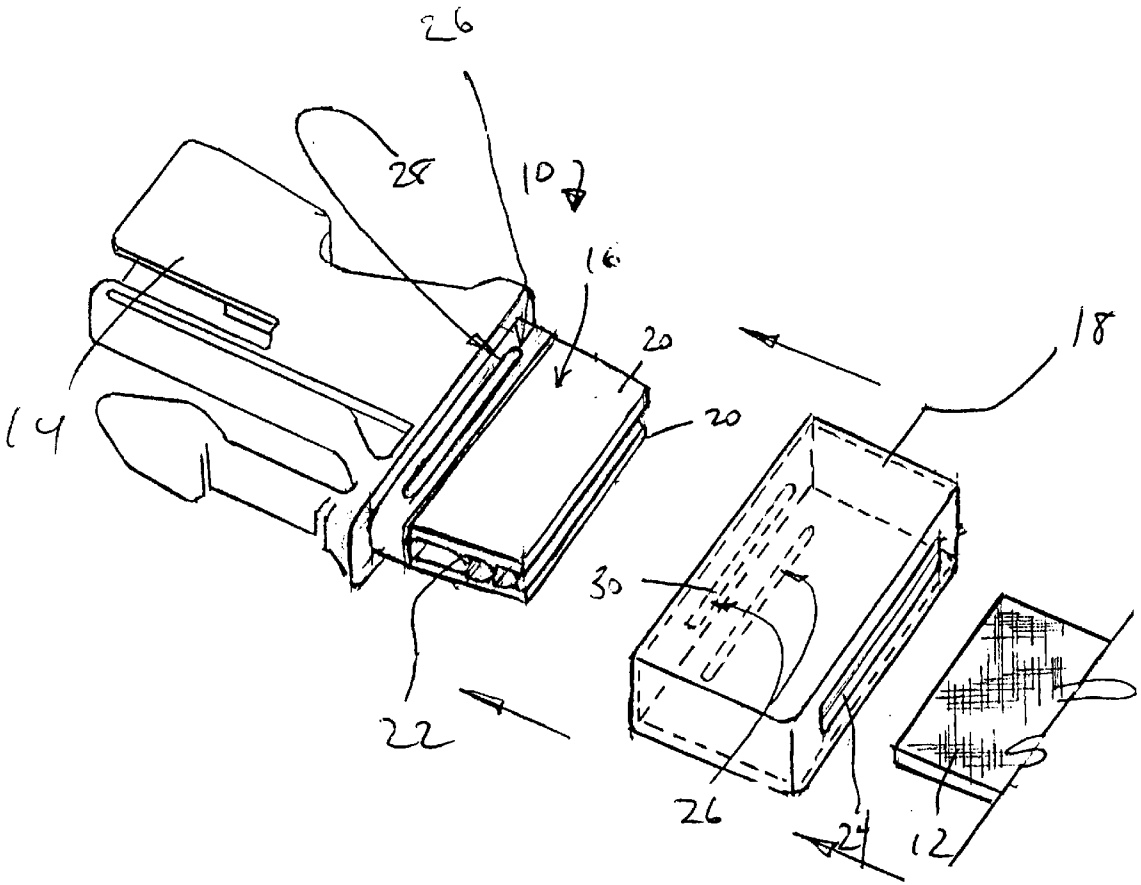
FIG. 3 is an exploded perspective view illustrating another embodiment of the connector device for releasably securing a strap and a fastening mechanism together, constructed in accordance with the present invention.
Figure 4:
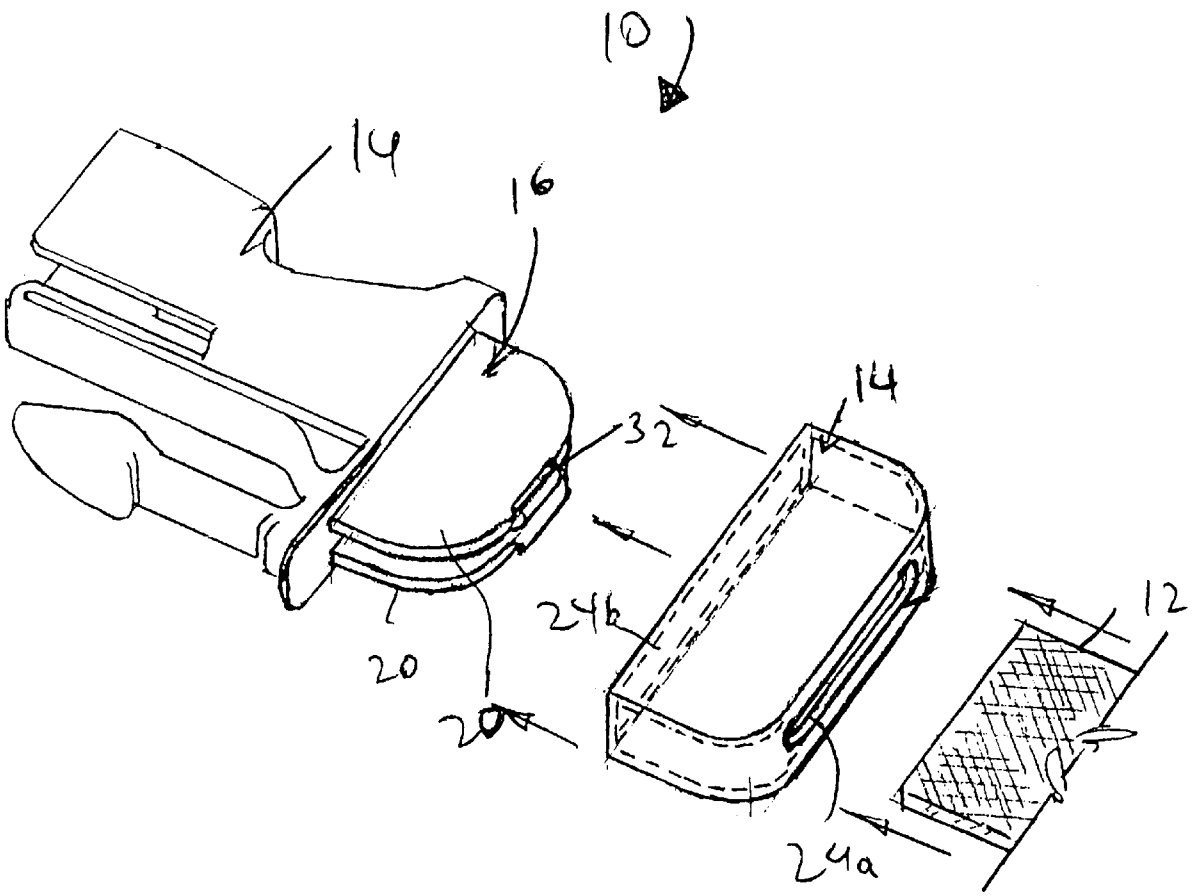
FIG. 4 is an exploded perspective view illustrating still another embodiment of the connector device for releasably securing a strap and a fastening mechanism together, constructed in accordance with the present invention, with a male entity and a female locking sleeve.
Figure 11:
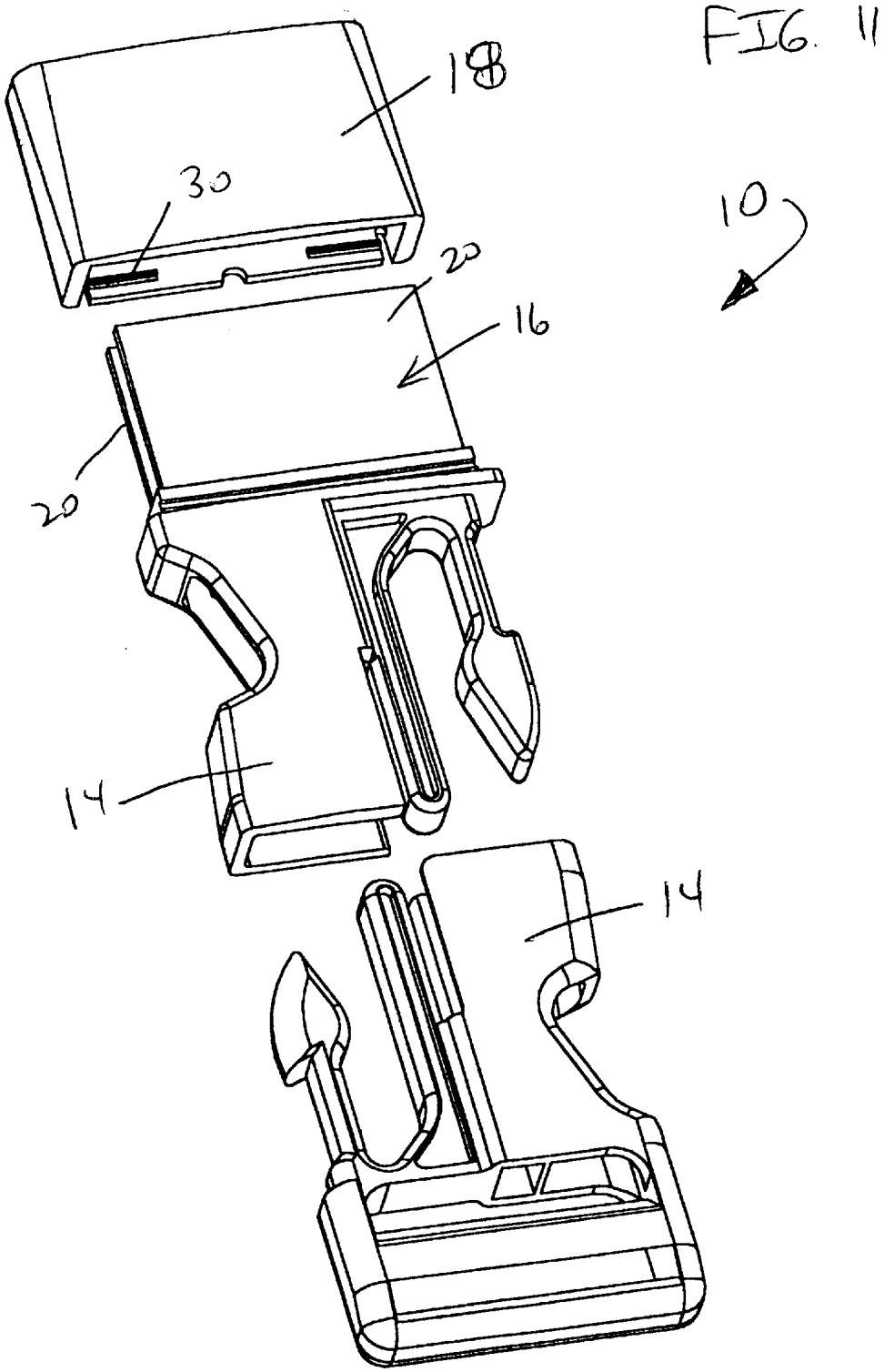
FIG. 11 is a perspective view illustrating another embodiment of the connector device for releasably securing a strap and a fastening mechanism together, constructed in accordance with the present invention.
Figure 12:
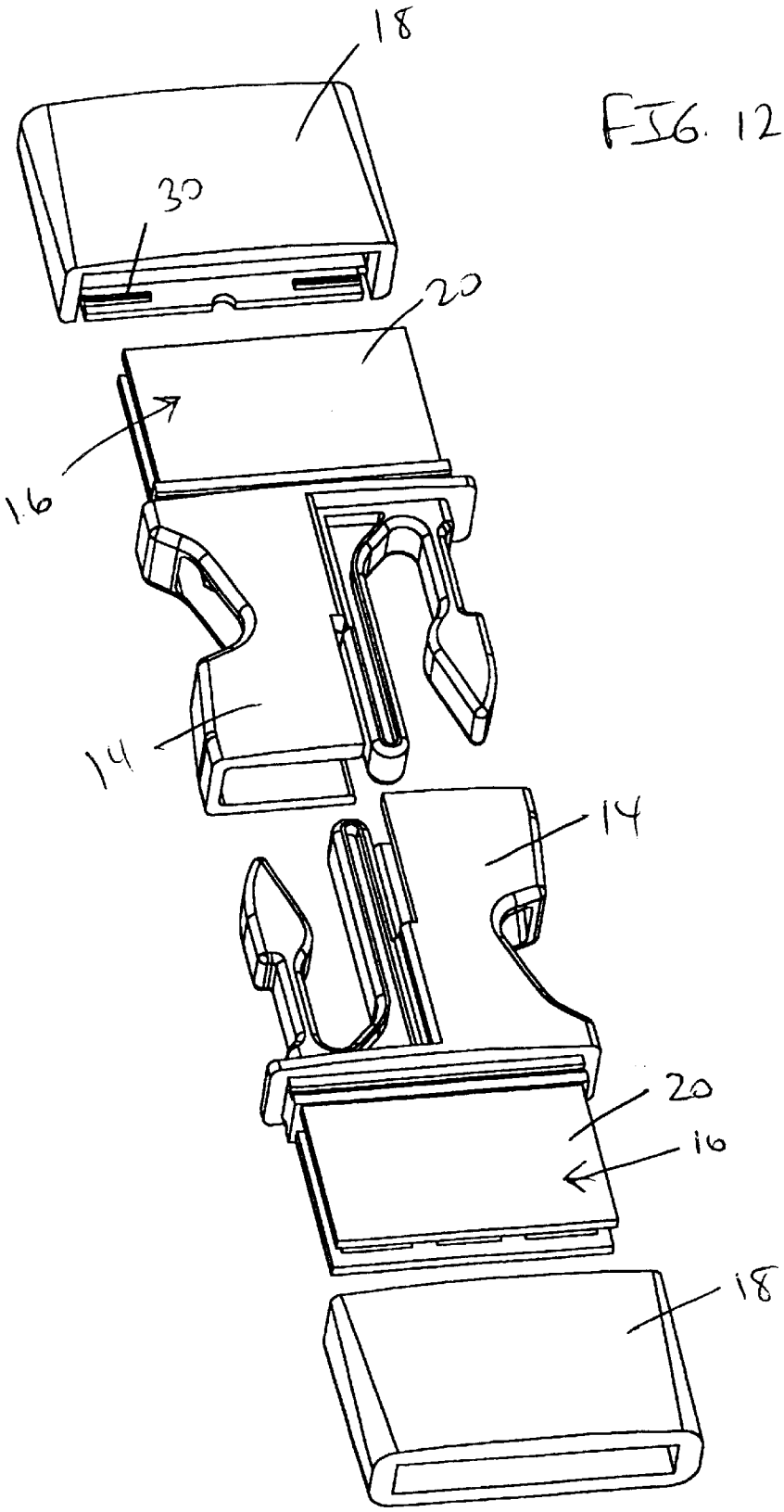
FIG. 12 is a perspective view illustrating yet another embodiment of the connector device for releasably securing a strap and a fastening mechanism together, constructed in accordance with the present invention.
Figure 13:
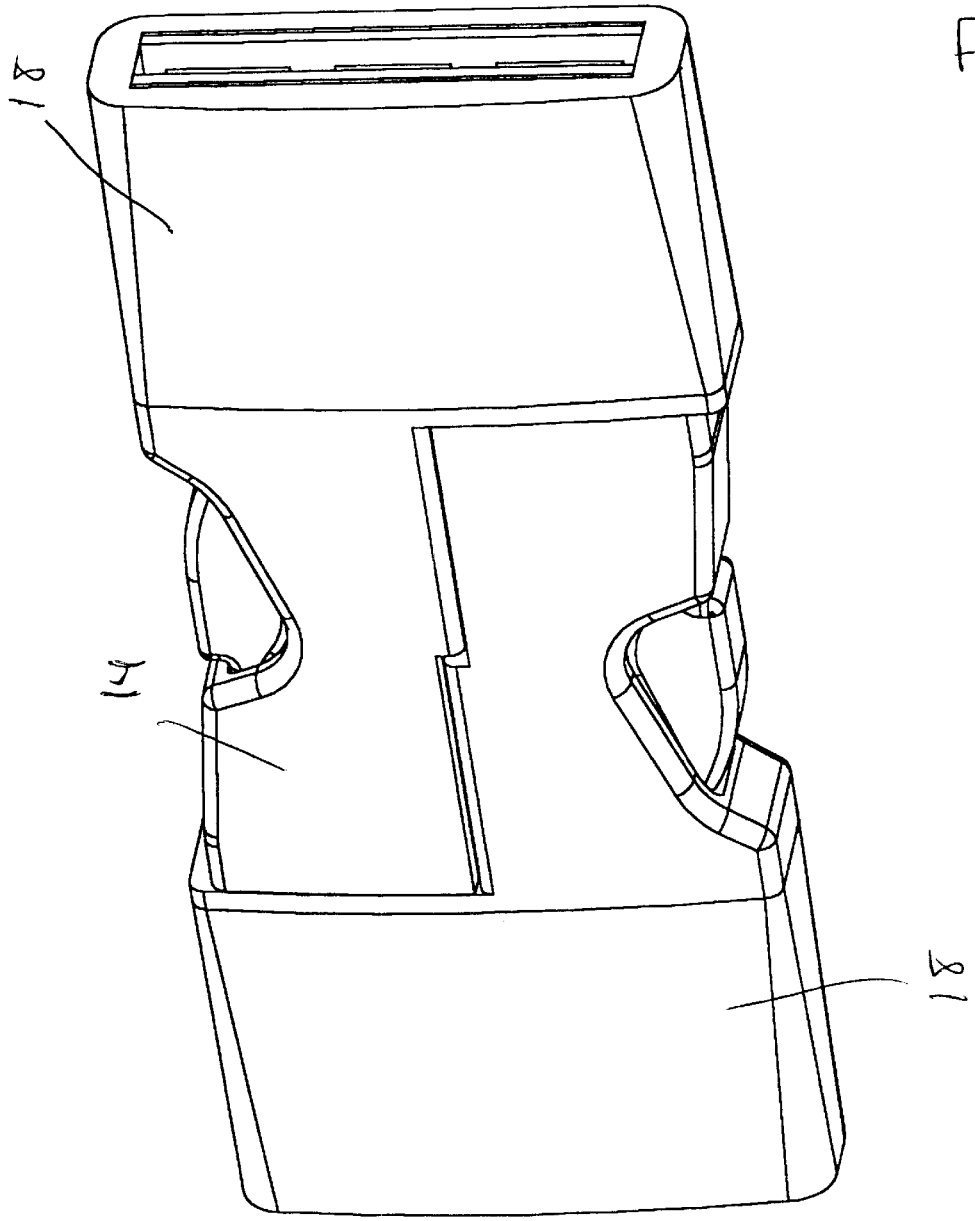
FIG. 13 is a perspective view illustrating the embodiment of the connector device for releasably securing a strap and a fastening mechanism together of FIG. 12, constructed in accordance with the present invention.

As illustrated in FIGS. 3 and 4, the connector device 10 of the present invention includes a male compression entity 16 attached to the fastening mechanism 14 and a female compression sleeve 18 positionable over the male compression entity 16. Preferably, the male compression entity 16 is constructed from the same material as the fastening mechanism 14 being formed with the fastening mechanism 14 during molding of the fastening mechanism 14. It is within the scope of the present invention, however, to form the male compression entity 16 from a different material than the fastening mechanism 14 and/or after the molding of the fastening mechanism 14.

As illustrated in FIGS. 8, 9, and 10, the male compression entity 16 of the connector device 10 includes a pair of compression members 20 each having opposed gripping teeth 22 with the strap member 12 being receivable between the compression members 20 and releasably frictionally gripped by the gripping teeth 22. The gripping teeth 22 can be formed with sharp points, as illustrated in FIG. 10, or the gripping teeth 22 can be formed in a serpentine configuration (not shown) thereby effectively gripping the strap member 12 and releasably securing the strap member 12 to the fastening mechanism 14. Furthermore, the gripping teeth 22 can be designed to allow easy insertion of the strap 12 between the compression members 20 and inhibit accidental or unintentional dislodgement of the strap 12 from between the compression members 20.

The compression members 20 can be a variety of configurations. For instance, as illustrated in FIGS. 1–3, the compression members 20 can have a substantially rectangular configuration. As illustrated in FIG. 4, the compression members 20 can have a substantially rounded configuration.

As illustrated in FIGS. 5, 6, and 7, the female compression sleeve 18 includes a pair of aligned strap-receiving slots 24, namely a first strap-receiving slot 24*a* and a second strap-receiving slot 24*b*, for receiving the strap member 12 therethrough. The first strap-receiving slot 24*a* can have a width less than, greater than, or equal to the width of the second strap-receiving slot 24*b*. In the preferred embodiment, during manufacture of the connector device 10, the width of the first strap-receiving slot 24*a* will vary depending on the width of the strap 14, i.e., three-quarter (¾") inch strap, one (1") inch strip, etc. In fact, the strap-receiving slots 24 can have a variety of sizes to accommodate a wide variety of strap sizes, cord sizes, etc. The second strap-receiving slot 24*b* will typically remain the same width as the male compression entity 16 to accommodate receiving the male compression entity 16, as will be described in further detail below.

Like the compression members 20 of the male compression entity 16, the female compression sleeve 18 can have a variety of configurations. For instance, as illustrated in FIG. 3, the female compression sleeve 18 can have a substantially rectangular configuration. As illustrated in FIG. 4, the female compression sleeve 18 can have a substantially rounded configuration. Preferably, the configuration of the female compression sleeve 18 substantially conforms to the configuration of the compression members 20 of the male compression entity 16.

To grip the strap member 12, the strap member 12 is inserted through the aligned strap-receiving slots 24 of the female compression sleeve 18 and guided between the compression members 20 of the male compression entity 16. The female compression sleeve 18 is then maneuvered over the male compression entity 16 causing the compression members 20 to move together releasably securing the strap member 12 in the gripping teeth 22. As illustrated in FIG. 7, the female compression sleeve 18 can be tapered from the second strap-receiving slot 24*b* to the first strap-receiving slot 24*a* to further cause compression of the compression members 20 of the male compression entity 16 allowing the strap 14 to be firmly secured between the compression members 20.

To releasably secure the female compression sleeve 18 to the male compression entity 16 thereby securing the strap member 12 to the fastening mechanism 14, the male compression entity 16 of the connector device 10 further includes locking mechanism 26 for releasably securing the female compression sleeve 18 over the male compression entity 16. In one embodiment, as illustrated in FIG. 3, the locking mechanism 26 includes a depression 28 formed in the male compression entity 16 for receiving a protrusion 30 formed on the inside surface of the female compression sleeve 18. In another embodiment, as illustrated in FIG. 4, the male compression entity 16 includes a tab 32 on the end of each compression member 20 to hold the female compression sleeve 18 in place once positioned over the male compression entity 16.

The connector device 10 of the present invention effectively centers the strap member 12 within the male compression entity 16 and the female compression sleeve 18. Inserts (not shown) can be added inside the female compression sleeve 18 to further guide the strap member 12 therein and center the strap member 12 within the connector device 10 and can be used for centering strap members 12 having a width less than the width of the aligned slots 24. Centering the strap member 12 allows the connector device 10 to firmly secure the strap member 12 and inhibit accidental or unintended removal of the strap member 12 from the fastening mechanism 14.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A connector mechanism for releasably securing a length of material and a fastening mechanism together, the connector device comprising:

a compressible first device connected to the fastening mechanism, at least a portion of the material receivable within the first device;

a second device positionable over at least a portion of the first device; and securing means associated with the first device and the second device for releasably securing the first device to the second device, the securing means being at least one tab formed on the first device such that when the second device is positioned over the first device, each tab extends beyond the second device;

wherein the second device compresses the first device about the portion of the material receivable therein thereby securing the first device to the material.

2. The connector mechanism of claim 1 wherein the first device has a first compression member and a second compression member, the first compression member and the second compression member movable in a direction generally toward each other to secure the material therebetween.

3. The connector mechanism of claim 2 wherein the first compression member has a plurality of gripping teeth and the second compression member has a plurality of gripping teeth, the opposed gripping teeth gripping the material within the first device.

4. The connector mechanism of claim 1 wherein the second device has a first material-receiving slot and a second material-receiving slot, the first material-receiving slot being aligned with the second material-receiving slot.

5. The connector mechanism of claim 4 wherein the second device is tapered between the second material-receiving slot and the first material-receiving slot.

6. A method for connecting material to a fastening mechanism, the method comprising:

extending a first compression member from the fastening mechanism;

extending a second compression member from the fastening mechanism;

inserting at least a portion of the material between the first compression member and the second compression member;

providing a compression member;

positioning the compression member over the first compression member and the second compression member;

releasably securing the compression member to the first compression member and the second compression member by at least one tab formed on the first compression member and the second compression member such that when the compression means is positioned over the first compression member and the second compression member, each tab extends beyond the compression member; and compressing the material between the first compression member and the second compression member.

7. The method of claim 6 and further comprising:

releasably securing the compression member to the first compression member and the second compression member.

8. The method of claim 6 and further comprising:

providing gripping means between the first compression member and the second compression member; and gripping the material between the first compression member and the second compression member.

9. A device for connecting a strap to a fastening mechanism, the device comprising:

gripping means connected to the fastening mechanism for gripping the strap;

compression means for compressing the gripping means about the strap; and securing means for releasably securing the compression means to the gripping means, the securing means being at least one tab formed on the gripping means such that when the compression means is positioned over the gripping means, each tab extends beyond the compression means.

10. The device of claim 9 wherein the gripping means is a compressible first device having a first compression member and a second compression member, the first compression member and the second compression member movable in a direction generally toward each other to secure the strap therebetween.

11. The device of claim 10 wherein the first compression member has a plurality of gripping teeth and the second compression member has a plurality of gripping teeth, the opposed gripping teeth gripping the strap within the first device.

12. The device of claim 9 wherein the compression means is a second device positionable over at least a portion of the gripping means.

13. The device of claim 12 wherein the second device has a first strap-receiving slot and a second strap-receiving slot, the first strap-receiving slot being aligned with the second strap-receiving slot.

14. The device of claim 13 wherein the second device is tapered between the second strap-receiving slot and the first strap-receiving slot.

* * * * *